US008480205B1

(12) United States Patent
Tsai

(10) Patent No.: US 8,480,205 B1
(45) Date of Patent: Jul. 9, 2013

(54) INK CLEANING APPARATUS FOR PRINTER

(75) Inventor: Kung-Huang Tsai, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/552,756

(22) Filed: Jul. 19, 2012

(30) Foreign Application Priority Data

Jun. 19, 2012 (TW) ..... 101121936 A

(51) Int. Cl.
*B41J 2/165* (2006.01)
*B41J 2/01* (2006.01)

(52) U.S. Cl.
USPC ..... 347/34; 347/102

(58) Field of Classification Search
USPC ..... 347/34, 102
See application file for complete search history.

(56) References Cited

U.S. PATENT DOCUMENTS 354,063 A * 12/1886 Johnson ..... 454/117
2006/0092215 A1* 5/2006 Brugue et al. ..... 347/30

FOREIGN PATENT DOCUMENTS

JP 02004511 A * 1/1990
JP 2007326274 A * 12/2007

* cited by examiner

*Primary Examiner* — Shelby Fidler
(74) *Attorney, Agent, or Firm* — Altis Law Group, Inc.

(57) ABSTRACT

An ink cleaning apparatus for a printer, includes an ink suction cover configured to suck loose ink and a valve assembly. The valve assembly includes a rotating gear and two pipes connected to the ink suction cover. The rotating gear defines a first receiving hole and a second receiving hole. A first fan and a second fan are mounted in the holes. One pipe connects to the first receiving hole, the other pipe connects to the second receiving hole. The rotating gear rotates to alternatively drive the first fan and the second fan to force air and loose ink in one of the two pipes from the ink suction cover, and drive the other fan to exhaust air with loose ink out of the other pipe.

18 Claims, 3 Drawing Sheets

INK CLEANING APPARATUS FOR PRINTER

BACKGROUND

1. Technical Field

The present disclosure relates to cleaning apparatuses, and more particularly to an ink cleaning apparatus for cleaning ink in a printer.

2. Description of Related Art

An ink-jet printer refers to an apparatus designed to perform printing by injecting ink whiled moving an ink cartridge. The ink cartridge is capable of storing and injecting the ink back and forth along a width direction of a fed printing medium. The ink cartridge has a bottom surface mounted with a head for spaying the ink. The head has nozzles to spray the ink. While the nozzles inject the ink on the printing medium, some ink may fly loose in the printer and contaminate components of the printer. Components of the printed may be damaged because of accumulated ink.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one".

Figure 1:
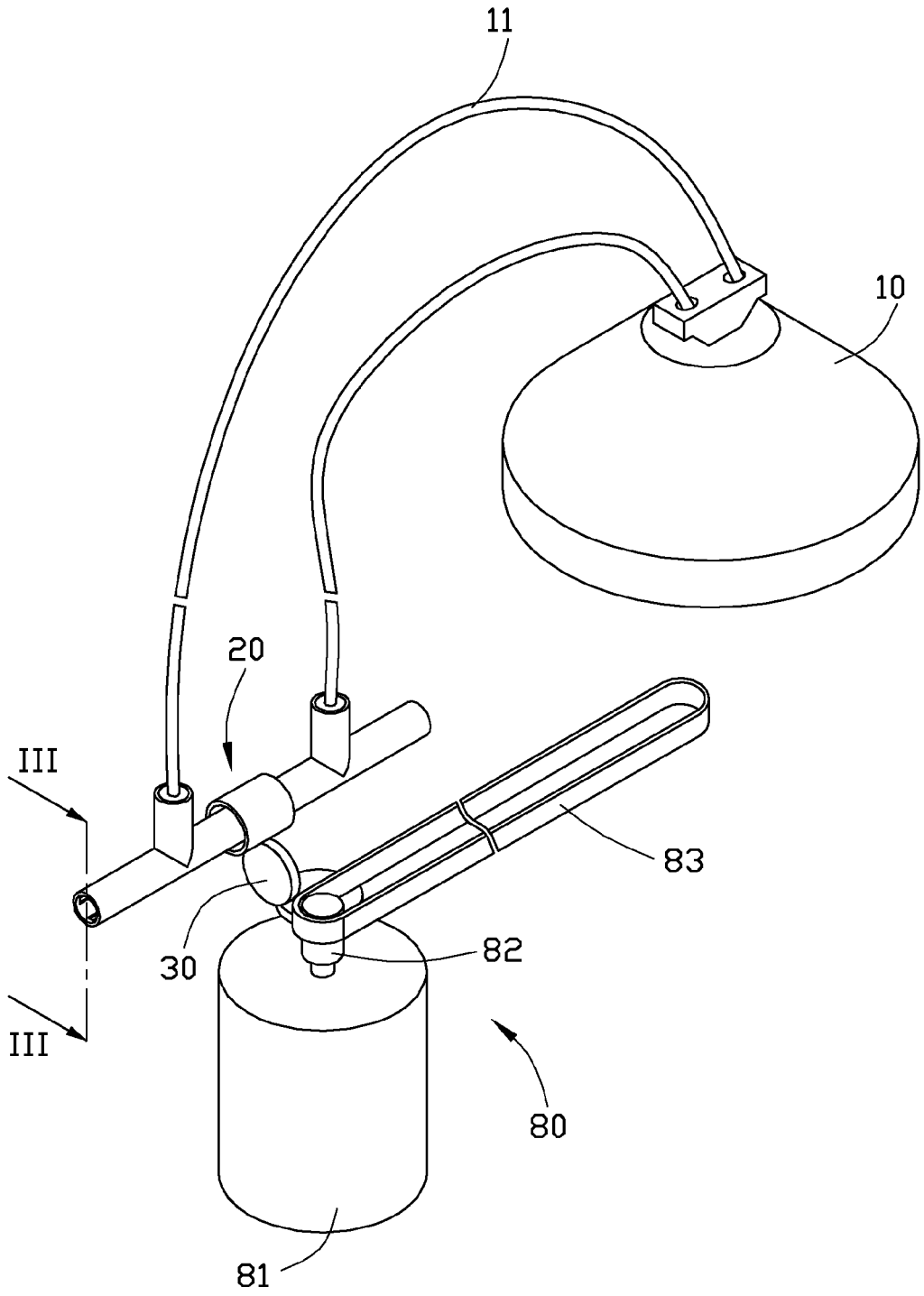
FIG. 1 is an exploded and isometric view of an embodiment of an ink cleaning apparatus for a printer.

FIG. 1 shows an ink cleaning apparatus for a printer in accordance with an embodiment. The ink cleaning apparatus includes an ink suction cover 10, two hoses 11, a valve assembly 20, a transmission module 30, and a driving module 80. In one embodiment, the driving module 80 is used to move an injecting head (not shown) for injecting ink on a fed printing medium in a printer.

Figure 2:
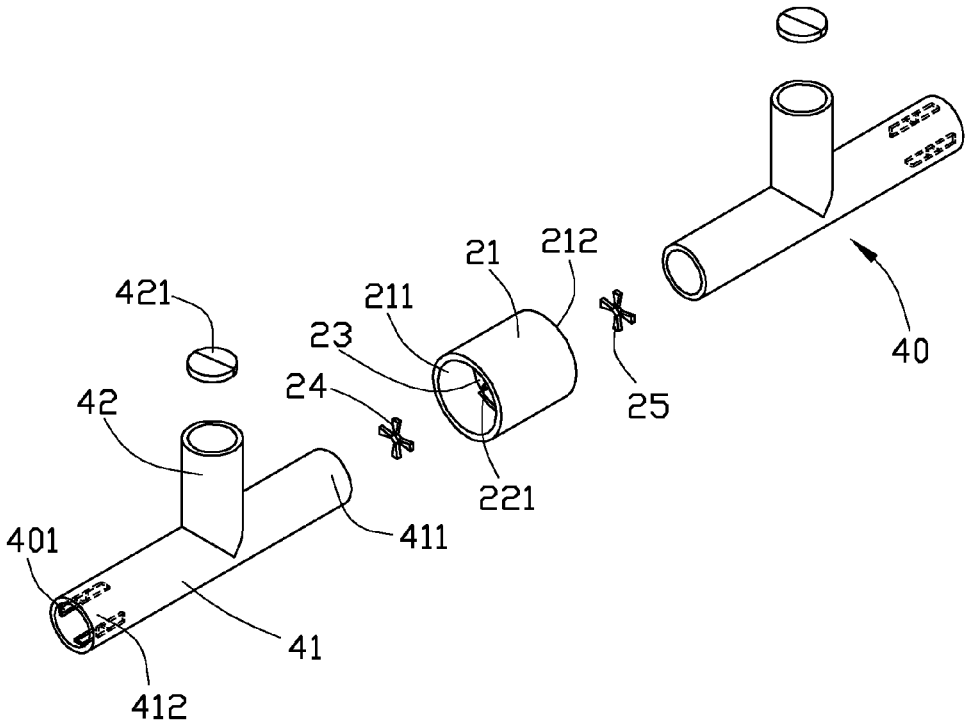
FIG. 2 is an exploded and isometric view of a valve module of the ink cleaning apparatus of FIG. 1.

Referring to FIG. 2, the valve assembly 20 includes a rotating gear 21 and two pipes 40. One side of the rotating gear 21 defines a first receiving hole 211, and the other side of the rotating gear 21 defines a second receiving hole 212. A partition wall 23 is located between the first receiving hole 211 and the second receiving hole 212 to separate the first receiving hole 211 and the second receiving hole 212. A first shaft 221 is fixed in the first receiving hole 211. A second shaft 222 (referring to FIG. 3) is fixed in the second receiving hole 212. A first fan 24 is rotatably mounted on the first shaft 221. A second fan 25 is rotatably mounted on the second shaft 222.

The pipe 40 includes a first pipe 41 and a second pipe 42. The first pipe 41 is linked to a center portion of the second pipe 42 and communicates with the second pipe 42. The first pipe 41 includes a first end 411 and a second end 412. The first end 411 can be inserted in the first receiving hole 211 or in the second receiving hole 212, and be sealed with an inner side of the first receiving hole 211 or with the second receiving hole 212.

Figure 3:
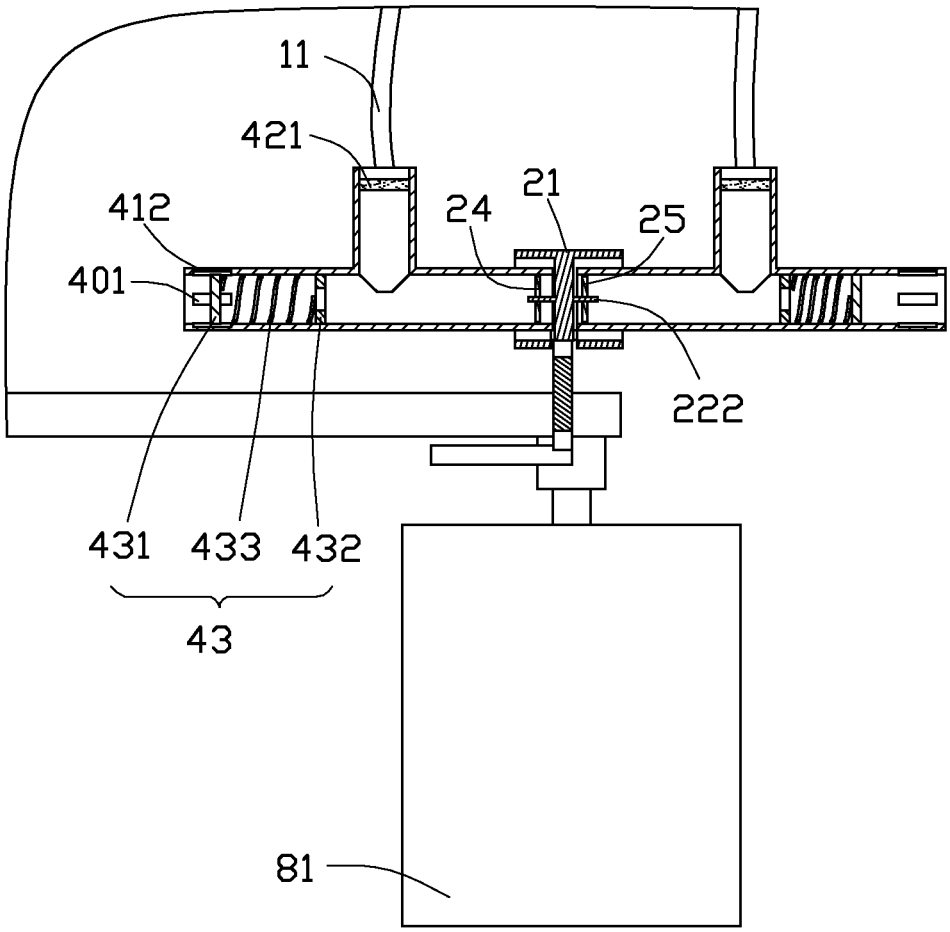
FIG. 3 is a sectional view in an enlarged scale taken along line III-III of FIG. 1.

Referring to FIG. 3, a valve 43 is mounted in the second end 412 of the first pipe 41. The valve 43 includes a sealing piece 431, a fixing piece 432, and a spring 433. The fixing piece 432 is fixed in the first pipe 41. The fixing piece 432 defines a hole in a center portion thereof. The sealing piece 431 is slidably mounted in the first pipe 41. The sealing piece 431 is sealed with an inner side of the first pipe 41 in a sealed position. The spring 433 is connected between the sealing piece 431 and fixing piece 432. A plurality of indentations 401 are defined in the inner side of the first pipe 41. The plurality of indentations 401 are located in the second end 412 and adjacent to the sealing piece 431. The sealing piece 431 can slide to an unsealed position from the sealed position. At the unsealed position, the sealing piece 431 is aligned to the plurality of indentations 401 to allow communication between the inner side of first pipe 41 and an exterior of the first pipe 41. The spring 433 is elastically extended when the sealing piece 431 is located at the unsealed position. When the spring 433 is uncompressed, the sealing piece 431 is misaligned with the plurality of indentations 401 to seal the first pipe 41.

A one-way valve 421 is mounted in the second pipe 42. The one-way valve 421 allows air into the second pipe 42, and prevents air flowing out of the second pipe 42 via the one-way valve 421.

Referring to FIG. 1, the driving module 80 includes a motor 81 and a driving gear 82. The motor 81 can rotate the driving gear 82. A belt 83 engages with the driving gear 82. The injecting head is linked to the belt 83. The motor 81 rotates the driving gear 82 in a clockwise direction or in a counterclockwise direction to move the injecting head back and forth across the width of the printer.

The transmission module 30 is linked between the driving gear 82 and the rotating gear 21. The driving gear 82 rotates the rotating gear 21.

Referring to FIGS. 1 to 3, in assembly, a first end 411 of the first pipes 41 of the two pipes 40 is inserted into the first receiving hole 211 and into the second receiving hole 212 of the rotating gear 21. The rotating gear 21 is linked to the driving gear 82 via the transmission module 30. Two holes 11 connect the two second pipes 42 to the ink suction cover 10.

In operation, the motor 81 rotates the driving gear 82 to move the injecting head. The injecting head injects ink on a printing medium. Simultaneously, the rotating gear 21 rotates. The first fan 24 and the second fan 25 rotate together with the rotating gear 21. Because the first fan 24 and the second fan 25 are rotating in a same direction, when the first fan 24 forces air in, the second fan 25 exhausts air out. In one embodiment, when the motor 81 rotates in a clockwise direction, the first fan 24 forces air in and the second fan 25 exhausts air out. When the motor 81 rotates in a counterclockwise direction, the first fan 24 exhausts air out and the second fan 25 forces air in.

When the first fan 24 creates pressure to force air in, ink is sucked in the first pipe 41 via the ink suction cover 10, the one-way valve 421, and the second pipe 42. When the second fan 25 exhausts out air, air pushes the sealing piece 431 to extend the spring 433. The sealing piece 431 slides in the first pipe 41 to a position of alignment with the indentations 401. Then, the first pipe 41 is unsealed, and air with ink flows out the first pipe 41. When the first fan 24 is not trying to take out the air, the sealing piece 431 slides back to seal the second end of 412 of the second pipe 41. The second fan 25 works in the same way as the first fan 24.

In the ink cleaning apparatus, the first fan 24 and the second fan 25 alternatively sucks in ink and exhaust out ink together with the movement of the injecting head. Therefore, loose ink in the printer is cleaned automatically.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. An ink cleaning apparatus for a printer, comprising:

an ink suction cover configured to suck ink; and a valve assembly comprising a rotating gear and two pipes connected to the ink suction cover, the rotating gear defining a first receiving hole and a second receiving hole, a first fan mounted in the first receiving hole, a second fan mounted in the second receiving hole; one of the two pipes connected to the first receiving hole, and another one of the two pipes connected to the second receiving hole;

wherein the rotating gear is configured to rotate to alternatively drive one of the first fan or the second fan to force air with ink into one of the two pipes from the ink suction cover, and drive another one of the first fan and the second fan to exhaust air with ink out of the another one of the two pipes.

2. The ink cleaning apparatus of claim 1, wherein a motor comprises a driving gear, the rotating gear links to the driving gear, and the motor is configured to rotate the driving gear to further rotate the rotating gear.

3. The ink cleaning apparatus of claim 2, wherein a belt is engaged with the driving gear, and the belt is configured to move an injection head.

4. The ink cleaning apparatus of claim 1, wherein each of two pipes comprises a first pipe and a second pipe, the first pipe comprises a first end and a second end; the first end is inserted in the first receiving hole or the second receiving hole, and sealed with an inner side of the first receiving hole or the second receiving hole that the first end is inserted into; the second end is equipped with a valve, and the second pipe is connected between the first pipe and the ink suction cover.

5. The ink cleaning apparatus of claim 4, wherein the valve comprising a sealing piece and a fixing piece, the fixing piece is fixed in the first pipe, the fixing piece defines a hole, a spring is connected between the fixing piece and the sealing piece, and the sealing piece is adapted to slide in the first pipe between a sealed position and a unsealed position.

6. The ink cleaning apparatus of claim 5, wherein a plurality of indentations are defined in the inner side of the first pipe and adjacent to the sealing piece; at the unsealed position, the sealing piece is aligned to the plurality of indentations; and at the sealed position, the sealing piece is misaligned with the plurality of indentations.

7. The ink cleaning apparatus of claim 6, wherein the first fan or the second fan is configured to drive air with ink to push the sealing piece to slide from the unsealed position to the sealed position; at the unsealed position, the spring is elastically extended; at the sealed position, the spring is in a nature state; and the spring is adapted to pull the sealing piece to slide from the sealed position to the unsealed position.

8. The ink cleaning apparatus of claim 4, wherein a one-way valve is mounted in the second pipe, and the one-way valve is configured to allow air with ink to flow into the second pipe, and to prevent air with ink flowing out of the second pipe.

9. The ink cleaning apparatus of claim 1, wherein the first fan and the second fan rotate in a same direction.

10. The ink cleaning apparatus of claim 1, wherein a partition wall is located between the first receiving hole and the second receiving hole to separate the first receiving hole and the second receiving hole.

11. An ink cleaning apparatus for a printer, comprising:

an ink suction cover configured to suck ink; and a valve assembly comprising a rotating gear and a pipe connected to the ink suction cover, the rotating gear defining a first receiving hole, a first fan mounted in the first receiving hole, the pipe connected to the first receiving hole and sealed with the first receiving hole;

wherein the rotating gear is configured to alternatively rotate in a clockwise direction or a counterclockwise direction to alternatively drive the first fan to force air with ink into the pipe from the ink suction cover or to exhaust air with ink out of the pipe.

12. The ink cleaning apparatus of claim 11, wherein a motor comprises a driving gear, the rotating gear links to the driving gear, and the motor is configured to rotate the driving gear to further rotate the rotating gear.

13. The ink cleaning apparatus of claim 12, wherein a belt is engaged with the driving gear, and the belt is configured to move an injection head.

14. The ink cleaning apparatus of claim 11, wherein the pipe comprises a first pipe and a second pipe, the first pipe comprises a first end and a second end; the first end is inserted into the first receiving hole and sealed with an inner side of the first receiving hole; the second end is equipped with a valve, and the second pipe is connected between the first pipe and the ink suction cover.

15. The ink cleaning apparatus of claim 14, wherein the valve comprising a sealing piece and a fixing piece, the fixing piece is fixed in the first pipe, the fixing piece defines a hole, a spring is connected between the fixing piece and the sealing piece, and the sealing piece is adapted to slide in the first pipe between a sealed position and a unsealed position.

16. The ink cleaning apparatus of claim 15, wherein an indentation is defined in the inner side of the first pipe and adjacent to the sealing piece; at the unsealed position, the sealing piece is aligned to the indentation; and at the sealed position, the sealing piece is misaligned with the indentation.

17. The ink cleaning apparatus of claim 16, wherein the first fan is configured to drive air with ink to push the sealing piece to slide from the unsealed position to the sealed position; at the unsealed position, the spring is elastically extended; at the sealed position, the spring is in a nature state; and the spring is adapted to pull the sealing piece to slide from the sealed position to the unsealed position.

18. The ink cleaning apparatus of claim 14, wherein a one-way valve is mounted in the second pipe, and the one-way valve is configured to allow air with ink to flow into the second pipe, and to prevent air with ink flowing out of the second pipe.

* * * * *